US008172041B2

(12) United States Patent
Kawasaki et al.

(10) Patent No.: US 8,172,041 B2
(45) Date of Patent: May 8, 2012

(54) MACHINE ROOM-LESS ELEVATOR

(75) Inventors: Kan Kawasaki, Fuchu (JP); Ikuo Asami, Fuchu (JP); Takashi Ishii, Fuchu (JP); Shun Fujimura, Fuchu (JP); Satoshi Takasawa, Fuchu (JP)

(73) Assignee: Toshiba Elevator Kabushiki Kaisha, Tokyo-To (JP)

( * ) Notice: Subject to any disclaimer, the term of this patent is extended or adjusted under 35 U.S.C. 154(b) by 340 days.

(21) Appl. No.: 11/597,906

(22) PCT Filed: Jun. 1, 2004

(86) PCT No.: PCT/JP2004/007512

§ 371 (c)(1),
(2), (4) Date: Aug. 21, 2007

(87) PCT Pub. No.: WO2005/118451

PCT Pub. Date: Dec. 15, 2005

(65) Prior Publication Data

US 2008/0277207 A1 Nov. 13, 2008

(51) Int. Cl.

| | |
|---|---|
| ***B66B 11/08*** | (2006.01) |
| ***B66B 7/00*** | (2006.01) |
| ***B66B 7/06*** | (2006.01) |

(52) U.S. Cl. ..... 187/266; 187/254

(58) Field of Classification Search ..... 187/266; *B66B 7/06, 11/08, 7/00*

See application file for complete search history.

(56) References Cited

U.S. PATENT DOCUMENTS

| | | | | |
|---|---|---|---|---|
| 3,101,130 | A * | 8/1963 | Bianca | 187/244 |
| 5,429,211 | A * | 7/1995 | Aulanko et al. | 187/254 |
| 5,957,243 | A * | 9/1999 | Root et al. | 187/266 |
| 6,626,266 | B2 * | 9/2003 | Hamaguchi | 187/266 |
| 7,267,200 | B2 * | 9/2007 | Orrman | 187/266 |
| 2004/0129501 | A1 * | 7/2004 | Wittur et al. | 187/254 |

(Continued)

FOREIGN PATENT DOCUMENTS

EP 1172321 A1 * 1/2002

(Continued)

OTHER PUBLICATIONS

U.S. Appl. No. 10/548,947, filed Sep. 15, 2005, Ishii, et al.

(Continued)

*Primary Examiner* — Michael Mansen
*Assistant Examiner* — Stefan Kruer
(74) *Attorney, Agent, or Firm* — Oblon, Spivak, McClelland, Maier & Neustadt, L.L.P.

(57) ABSTRACT

A machineroom-less elevator in which a counterweight is vertically moved behind a cage, with the cage and the counterweight being suspended in a jig back manner through a first and second diverting sheaves. In this machineroom-less elevator, a sufficiently large vertical stroke of the counterweight can be secured, while a durability of a hoist rope is improved. In addition, since no tensile difference is generated in respective parts of the hoist rope, vertical vibrations of the cage are prevented when the cage restarts a vertical movement. A traction sheave is disposed on one of right and left sidewalls of an elevator shaft. A first diverting sheave is disposed below and sufficiently apart from the traction sheave, and a second diverting sheave is disposed on a top of a rear wall of the elevator shaft. The traction sheave is disposed to be inclined relative to the sidewall such that a rotational axis thereof extends from the sidewall of the elevator shaft to the rear wall thereof, when viewed vertically from above.

10 Claims, 7 Drawing Sheets

U.S. PATENT DOCUMENTS

| | | | |
|---|---|---|---|
| 2004/0182651 | A1 | 9/2004 | Ishii et al. |
| 2004/0206580 | A1 | 10/2004 | Ishii et al. |
| 2005/0178621 | A1 | 8/2005 | Kawasaki et al. |
| 2006/0042885 | A1 | 3/2006 | Kawasaki et al. |
| 2006/0163009 | A1 | 7/2006 | Ishii et al. |

FOREIGN PATENT DOCUMENTS

| | | | | |
|---|---|---|---|---|
| EP | 1327596 | A1 | * | 7/2003 |
| JP | 7-61745 | | | 3/1995 |
| JP | 2001-80843 | | | 3/2001 |
| JP | 2002-145555 | | | 5/2002 |
| JP | 2002362849 | A | * | 12/2002 |
| JP | 2003104657 | A | * | 4/2003 |
| JP | 2003-306282 | | | 10/2003 |
| JP | 2003306282 | A | * | 10/2003 |
| JP | 2004-115161 | | | 4/2004 |
| JP | 2004-189346 | | | 7/2004 |
| JP | 2005-029344 | | | 2/2005 |
| JP | 2002-179356 | | | 6/2008 |
| WO | WO 01/62654 | A1 | | 8/2001 |
| WO | 02/18256 | | | 3/2002 |
| WO | WO02/074677 | | | 9/2002 |

OTHER PUBLICATIONS

U.S. Appl. No. 10/549,917, filed Sep. 20, 2005, Izumi, et al.

* cited by examiner

PRIOR ART

MACHINE ROOM-LESS ELEVATOR

BACKGROUND OF THE INVENTION

1. Field of the Invention

The present invention relates a machineroom-less elevator having no machineroom disposed above an elevator shaft.

2. Description of the Related Art

Various machineroom-less elevators having no machineroom disposed above an elevator shaft have been developed and proposed for efficiently utilizing spaces in buildings and for observing regulations regarding the right to sunlight.

For example, in a conventional machineroom-less elevator shown in FIGS. 5 to 7, a cage 1 that is moved vertically in an elevator shaft 2 is guided by a pair of right and left cage-side guide rails 1L and 1R. A counterweight 3 disposed behind the cage 1 is guided by a pair of right and left counterweight-side guide rails 3L and 3R, the counterweight 3 to be vertically moved in the elevator shaft 2 along a rear wall thereof.

A driving apparatus 4 secured on a top of the elevator shaft 2 on a rear wall 2*r* thereof drives a traction sheave 5 in rotation about a rotational axis horizontally extending in the back and forth direction.

A first diverting sheave 6 capable of being rotated about a rotational axis extending in the back and forth direction is disposed at a position directly below a left end of the driving apparatus 4 on a side of the rear wall 2*r* of the elevator shaft 2.

A second diverting sheave 7 capable of being rotated about a rotational axis extending in a right and left direction is disposed on a position above the first diverting sheave 6 on a side of a left wall 2L of the elevator shaft 2.

A hoist rope 8 passed round the traction sheave 5 has one end 8*a* extending downward to be passed round the first diverting sheave 6, then extending upward (8*b*) to be passed round the second diverting sheave 7, extending downward (8*c*) from the second diverting sheave 7, horizontally extending (8*d*) between a pair of right and left cage-side sheaves 1*a* and 1*b* which are attached under the cage 1, and then extending upward from the right cage-side sheave 1*b* to be secured on a front hitch part 9*f*, so as to suspend the cage 1 in a two-to-one roping arrangement.

The other end 8*f* of the hoist rope 8 extends downward toward the counterweight 3 to be passed round a counterweight-side sheave 3*a* and then extends upward to be secured on a rear hitch part 9*r*, so as to suspend the counterweight 3 in a two-to-one roping arrangement.

In the conventional machineroom-less elevator shown in FIGS. 5 to 7, the driving apparatus 4 is disposed on the rear wall 2*r* of the elevator shaft 2, and the counterweight 3 is vertically moved along the rear wall 2*r* of the elevator shaft 2.

In such a constitution, since the first diverting sheave 6 must be disposed below the driving apparatus 4, a sufficiently large vertical stroke of the counterweight 3 cannot be secured because of an interference between the first diverting sheave 6 and the counterweight 3.

In order to secure a sufficiently large vertical stroke of the counterweight 3, when the first diverting sheave 6 is disposed on a higher position, the first diverting sheave 6 comes near the traction sheave 5 and the second diverting sheave 7.

Then, the hoist rope 8 is curved in an S-shape, because extending directions of the part between the traction sheave 5 and the part between the first diverting sheave 6 and the second diverting sheave 7 are suddenly changed.

Thus, there is a fear the durability of the hoist rope 8 may deteriorate.

Further, when the cage 1 stops, a tensile difference is generated in the respective parts 8*a* and 8*b* of the hoist rope 8 which are respectively extending upward from the first diverting sheave 6, so that vertical vibrations of the cage 1 may be generated when the cage 1 restarts a vertical movement.

Each torsion angle of the parts 8*a* and 8*b* of the hoist rope 8 is 90 degrees, the parts 8*a* and 8*b* respectively extending between the traction sheave 5 and the first diverting sheave 6, and between the first diverting sheave 6 and the second diverting sheave 7. Thus, when the hoist rope 8 is formed by a plurality of ropes of a smaller diameter, a displacement of an angle between a direction of rope grooves of the respective sheaves and a direction to which the respective ropes extend from the respective rope grooves is enlarged, so that a generation of noises and vibrations accompanied with a contact of the respective ropes formed by twisting lines with the respective rope grooves can be prevented.

On the other hand, when the driving apparatus 4 and the traction sheave 5 are disposed on the left wall 2L of the elevator shaft 2 in order to solve the above disadvantages, the diverting sheaves must be disposed on the left wall 2L of the elevator shaft 2 for guiding a part of the hoist rope 8 on a side of the rear wall 2*r* extending downward from the traction sheave 5 to the counterweight 3 on the side of the rear wall 2*r*.

In such a constitution, since the driving apparatus 4, the traction sheave 5, and the diverting sheaves are arranged in the back and forth direction when viewed vertically from above, a part of the hoist rope 8 extending downward from the traction sheave 5 to the cage-side sheave 1*a* is positioned in front of the elevator shaft 2.

Thus, it becomes difficult to conform the part 8*d* of the hoist rope 8, which horizontally extends between the pair of right and left cage-side sheaves 1*a* and 1*b*, to a center of gravity G of the cage 1, when viewed vertically from above.

Further, since the cage-side sheaves 1*a* and 1*b* supporting the cage 1 are disposed under the cage, an operation space where an operator inspects the cage-side sheaves 1*a* and 1*b* must be secured in a pit disposed on a bottom of the elevator shaft, with a large depth of the pit being needed.

In addition, in order that the hoist rope 8 extends along right and left sidewalls 1*c* and 1*d* of the cage 1, the pair of right and left cage-side sheaves 1*a* and 1*b* are obliged to project from the right and left sidewalls 1*a* and 1*b* of the cage 1. Thus, when a dimension W of the cage 1 in the right and left direction (a direction in which a door is opened and closed) is secured, a dimension L of a cross-section of the elevator shaft in the right and left direction is adversely enlarged.

In other words, when the dimension L of the cross-section of the elevator shaft in the right and left direction is fixed at a certain dimension, the dimension W of the cage 1 in the right and left direction must be reduced.

Maintenance of the driving apparatus 4, the traction sheave 5, and a controller CP fixed to a top sidewall of the elevator shaft must be carried out by elevating the cage 1, on which an operator stands, to an uppermost position.

On the other hand, maintenance of the cage-side sheaves 1*a* and 1*b* must be carried out by lowering the cage 1 to a lowermost position in the pit.

Thus, in the conventional machineroom-less elevator, a maintenance operation cannot be efficiently carried out because an operator must move up and down between an uppermost floor and a lowermost floor of a building.

Another machineroom-less elevator has been proposed in which the diverting sheave 7 in FIG. 5 is replaced with a traction sheave, and a driving apparatus is disposed such that a rotational axis thereof extends in the same direction as that of the part 8*d* of the hoist rope 8 extending between the cage-side sheaves 1*a* and 1*b*. With a rotation of the traction sheave, the counterweight 3 is vertically moved behind the cage 1.

However, the machineroom-less elevator of such a constitution has some disadvantages to be solved, with respect to a durability of the hoist rope, supporting manner of the driving apparatus, vibrations, and so on.

Therefore, it is a first object of the present invention to provide a machineroom-less elevator where a counterweight is vertically moved behind a cage, which is capable of solving the above disadvantages of the conventional art. In the machineroom-less elevator, a vertical stroke of a counterweight can be sufficiently secured, while a durability of a hoist rope is improved by mitigating a drawing of the hoist rope. Since no tensile difference is generated in respective parts of the hoist rope, vertical vibrations of the cage are prevented when the cage restarts a vertical movement. Further, a generation of noises and vibrations accompanied with a contact of rope grooves of respective sheaves with the hoist rope can be prevented.

It is a second object of the present invention to provide a machineroom-less elevator which is improved such that a depth of a pit in a bottom of an elevator shaft is reduced, and that a maintenance operation can be centrally carried out above a cage. Further, a dimension of a cross-section of the elevator shaft in the right and left direction is restrained to be small relative to a width dimension of the cage. A hoist rope can be drawn such that a part of the hoist rope is conformed to a center of gravity of the cage when viewed vertically from above.

SUMMARY OF THE INVENTION

In order to solve the above disadvantages, a machineroom-less elevator comprising:

a cage that moves vertically in an elevator shaft guided by a pair of right and left cage-side guide rails;

a counterweight which has a counterweight-side sheave, and is guided by a pair of right and left counterweight-side guide rails to be vertically moved behind the cage along a rear wall of the elevator shaft;

a traction sheave which is disposed on a top of the elevator shaft near one of right and left sidewalls of the elevator shaft, and is driven in rotation about a rotational axis extending from the sidewall to the rear wall when viewed vertically from above;

a driving apparatus which drives the traction sheave in rotation;

a pair of right and left cage-side sheaves which suspend and support the cage on an upper part thereof, and are capable of being rotated about rotational axes parallel to a rotational axis of the traction sheave, or about rotational axes extending at an angle adjacent to the rotational axis of the traction sheave;

a first diverting sheave which is disposed lower than the traction sheave near the sidewall, and is rotated about a rotational axis extending in the right and left direction;

a second diverting sheave which is disposed higher than the first diverting sheave near the rear wall, and is rotated about a rotational axis extending in the back and forth direction; and a hoist rope passed round the traction sheave, with one end of the hoist rope suspending the cage through the pair of right and left cage-side sheaves, and the other end thereof suspending the counterweight through the first and second diverting sheaves and the counterweight-side sheaves, is provided.

In the machineroom-less elevator, the counterweight is vertically moved behind the cage along the rear wall of the elevator shaft, the traction sheave and the first diverting sheave are disposed near one of the right and left sidewalls of the elevator shaft, and the second diverting sheave is disposed on a top of the elevator shaft near the rear wall. Thus, even when the first diverting sheave is disposed sufficiently below the traction sheave, an interference between the first diverting sheave and the counterweight can be prevented.

The second diverting sheave can be disposed on an uppermost part of the elevator shaft irrespective of the position of the traction sheave. Thus, an interference between the second diverting sheave and the counterweight is prevented, so that a sufficiently large vertical stroke can be secured.

Since the first diverting sheave can be disposed sufficiently below the traction sheave, a curve of a part the hoist rope extending from the traction sheave to the counterweight-side sheave through the first and second diverting sheaves can be moderated. Thus, a durability of the hoist rope can be improved. Further, no tensile difference is generated in respective parts of the hoist rope, so that vertical vibrations of the cage caused when the cage restarts a vertical movement is prevented, and a generation of noises and vibrations accompanied with a contact of rope grooves of the respective sheaves with the hoist rope can be surely prevented.

In addition, a degree of freedom of an arrangement of cage-side sheaves can be enhanced, by suitably adjusting an angle of a rotational axis of the traction sheave relative to the sidewall of the elevator shaft, when viewed vertically from above. In other words, by adjusting the angle of the rotational axis of the traction sheave relative to the sidewall of the elevator shaft, the hoist rope can be drawn such that a part of the hoist rope between the pair of right and left cage-side sheaves and a center of gravity of the cage are overlapped with each other when viewed vertically from above.

Since the cage-side sheaves are disposed above the cage, there is no need to dispose an operation space for maintenance in a bottom of the elevator shaft, so that a depth of the pit can be reduced.

Maintenance of not only the traction sheave and the cage-side sheaves, but also the driving apparatus for driving the traction sheave in rotation and a controller CP disposed on a top of the elevator shaft for controlling an operation of the driving apparatus can be centrally carried out by an operator who stands on the cage. Thus, the operator needs not move up and down between an uppermost floor and a lowermost floor of a building, and a maintenance operation of the machineroom-less elevator can be efficiently carried out.

Since the hoist rope does not extend along the right and left sidewalls of the cage, it is unnecessary for the pair of right and left cage-side sheave to project from the right and left sidewalls of the cage. Thus, a larger space for the cage can be secured when a horizontal cross-section of the elevator shaft is made to be a constant one. In other words, a dimension of a horizontal cross-section of the elevator shaft can be made smaller, when a dimension of the horizontal cross-section of the cage is made to be a constant one.

In addition, there exits neither a cage-side sheave nor a hoist rope below the cage. Thus, a buffer disposed on a bottom of the elevator shaft can be disposed in opposition to a center part of a bottom surface of the cage.

A machineroom-less elevator in which the driving apparatus is coaxially disposed with the traction sheave, is provided.

The driving apparatus may be a gearless direct driving motor.

That is, when the traction sheave and the driving apparatus are disposed coaxially with each other, by suitably adjusting an angle of the rotational axis of the traction sheave relative to a sidewall of the elevator shaft when viewed vertically from above, the driving apparatus can be received between the sidewall and the rear wall of the elevator shaft, irrespective of a length of the rotational axis of the driving apparatus.

A machineroom-less elevator in which the hoist rope is formed by a plurality of ropes each having a diameter of 4 mm to 6 mm, is provided.

In such a machineroom-less elevator, since each of the respective ropes forming the hoist rope has a diameter of 4 mm to 6 mm, outer diameters of the traction sheave, the cage-side sheaves, and the counterweight-side sheave can respectively be restrained to be 200 mm to 250 mm.

Since a degree of freedom of an arrangement of the traction sheave and the pair of right and left cage-side sheaves in the elevator shaft can be enhanced, the hoist rope can be freely drawn such that a part of the hoist rope between the pair of right and left cage-side sheaves and a center of gravity of the cage are overlapped with each other when viewed vertically from above.

A machineroom-less elevator in which the rotational axis of the traction sheave and the rotational axes of the cage-side sheaves extend at an angle of 0 degree to 45 degrees when viewed vertically from above, is provided.

An angle formed by the rotational axis of the traction sheave and the rotational axes of the pair of right and left cage-side sheaves is, more preferably, 0 degree to 30 degrees, and most preferably, 0 degree to 15 degrees.

A machineroom-less elevator in which a torsion angle of a part of the hoist rope extending between the traction sheave and the cage-side sheaves can be reduced, is provided.

Thus, when the cage is elevated to an uppermost position so that a vertical gap between the traction sheave and the cage-side sheaves is narrowed, an inclination angle of the hoist rope relative to the traction sheave and rope grooves of the cage-side sheaves can be maintained to be small.

Therefore, when the hoist rope is formed by a plurality of ropes, a generation of noises and vibrations accompanied with a contact of the respective ropes formed by twisting lines with the rope grooves of the respective sheaves can be prevented.

A machineroom-less elevator in which the pair of right and left cage-side sheaves are respectively disposed near the right and left sidewalls of the cage, is provided.

In such a machineroom-less elevator, one of the right and left cage-side sheaves can be disposed directly below or near the traction sheave.

Since there is no need for intervening a diverting sheave between the traction sheave and the cage-side sheaves, it is possible to reduce a so-called top clearance, that is, a vertical gap between a ceiling of the elevator shaft and the cage.

As a winding angle of the hoist rope with respect to the traction sheave can be large, the hoist rope can be securely friction-engaged with the traction sheave.

A machineroom-less elevator in which the pair of right and left cage-side sheaves are disposed inside a vertical projection of the cage when viewed vertically from above, is provided.

In such a machineroom-less elevator, by bringing sidewalls of the cage close to an inner wall surface of the elevator shaft, a larger space for the cage can be secured when a horizontal cross-section of the elevator shaft is made to be constant.

In other words, a dimension of a horizontal cross-section of the elevator shaft can be made smaller, when a dimension of the horizontal cross-section of the cage is made to be constant.

A machineroom-less elevator in which the pair of right and left cage-side sheaves are disposed in symmetry with respect to a center of gravity of the cage when viewed vertically from above, is provided.

The center of gravity of the cage is supposed to be a position in design when there is no passenger in the cage.

In such a machineroom-less elevator, since the pair of right and left cage-side sheaves are disposed in symmetry with respect to a center of gravity of the cage when viewed vertically from above, a gravity acting on the cage and a force for suspending the cage upward are prevented from being largely offset from each other in the horizontal direction.

Thus, the cage can be suspended in a stable manner without inclination thereof, and can be vertically moved in a smooth manner without vibrations.

A machineroom-less elevator in which the driving apparatus is disposed such that at least a part thereof is overlapped with a vertical projection of the cage when viewed vertically from above, is provided.

In such a machineroom-less elevator, since at least a part of the driving apparatus is disposed above the cage, a space required for driving the traction sheave in rotation can be secured.

Since one of sidewalls of the cage to which the driving apparatus is disposed can be brought close to an inner wall surface of the elevator shaft, a larger space for the cage can be secured when a horizontal cross-section of the elevator shaft is made to be constant.

In other words, a dimension of a horizontal cross-section of the elevator shaft can be made smaller, when a dimension of the horizontal cross-section of the cage 10 is made to be constant.

A machineroom-less elevator in which the traction sheave is disposed such that at least a part thereof is overlapped with the cage when viewed vertically from above, is provided.

In such a machineroom-less elevator, a space required for the traction sheave can be secured, and the traction sheave can be disposed directly above or near one of the cage-side sheaves.

Since there is no need for intervening a diverting sheave between the traction sheave and the cage-side sheaves, it is possible to reduce a so-called top clearance, that is, a vertical gap between a ceiling of the elevator shaft and the cage.

Since a winding angle of the hoist rope with respect to the traction sheave can be as large as substantially 180 degrees, the hoist rope can be securely friction-engaged with the traction sheave.

In order to solve the above disadvantages, a machineroom-less elevator comprising:

a cage that moves vertically in an elevator shaft guided by a pair of right and left cage-side guide rails;

a counterweight which has a counterweight-side sheave, and is guided by a pair of right and left counterweight-side guide rails to be vertically moved behind the cage along a rear wall of the elevator shaft;

a traction sheave which is driven in rotation about a rotational axis extending from a rear side of one of right and left sidewalls of the elevator shaft to a front side of the other of the right and left sidewalls of the elevator shaft, when viewed vertically from above;

a driving apparatus which drives the traction sheave in rotation;

a pair of right and left cage-side sheaves which suspend and support the cage on an upper part thereof, with a hoist rope extending in a direction intersecting the rotational axis of the traction sheave;

a first diverting sheave which is rotated lower than the traction sheave; and a second diverting sheave which is rotated higher than the first diverting sheave; wherein the hoist rope is passed round the traction sheave, with one end of the hoist rope suspending the cage through the pair of right and left cage-side sheaves, and the other end thereof suspending the counterweight through the first and second diverting sheaves and the counterweight-side sheaves, is provided.

In order to solve the above disadvantages, a machineroom-less elevator comprising:

a cage that moves vertically in an elevator shaft guided by a rail;

a pair of cage-side sheaves disposed above the cage;

a counterweight which is vertically moved behind the cage in the elevator shaft;

a driving apparatus which has a rotational axis extending to intersect a line between the pair of cage-side sheaves;

a traction sheave which is driven in rotation by the driving apparatus;

a hoist rope suspended in the elevator shaft, with one end of the hoist rope extending from the traction sheave to be passed round the cage-side sheaves, and the other end thereof being passed round the counterweight; and a diverting sheave which is disposed below the driving apparatus between the traction sheave and the counterweight, is provided.

In such machineroom-less elevators, a degree of freedom of an arrangement of the driving apparatus can be enhanced.

By reducing a torsion angle of the hoist rope, a durability thereof can be improved. Further, a generation of noises and vibrations accompanied with a contact of the hoist rope with rope grooves of the respective sheaves can be prevented.

DETAILED DESCRIPTION OF THE INVENTION

An embodiment of a machineroom-less elevator according to the present invention is described with reference to FIGS. 1 to 4.

In the description below, a right and left direction is defined as a direction in which an entrance door of a cage is opened and closed, a front is defined as a direction in which passengers exit the cage, a rear is defined as a direction in which passengers enter the cage, and an up and down direction is defined as a vertical direction, respectively.

The same parts have the same reference numbers, and their description will be omitted.

A cage 10 of the embodiment of a machineroom-less elevator according to the present invention shown in FIGS. 1 to 4 moves vertically in an elevator shaft 2 installed in a building and is guided by a pair of right and left cage-side rails 11L and 11R.

A pair of right and left doors 12L and 12R disposed on a front surface of the cage 10 are opened and closed in the right and left direction.

A cage frame supporting the cage 10 includes an upper beam 13 horizontally extending above the cage 10 in the right and left direction, and a pair of right and left longitudinal beams 14L and 14R which are respectively connected to right and left ends of the upper beam 13.

Figure 3:
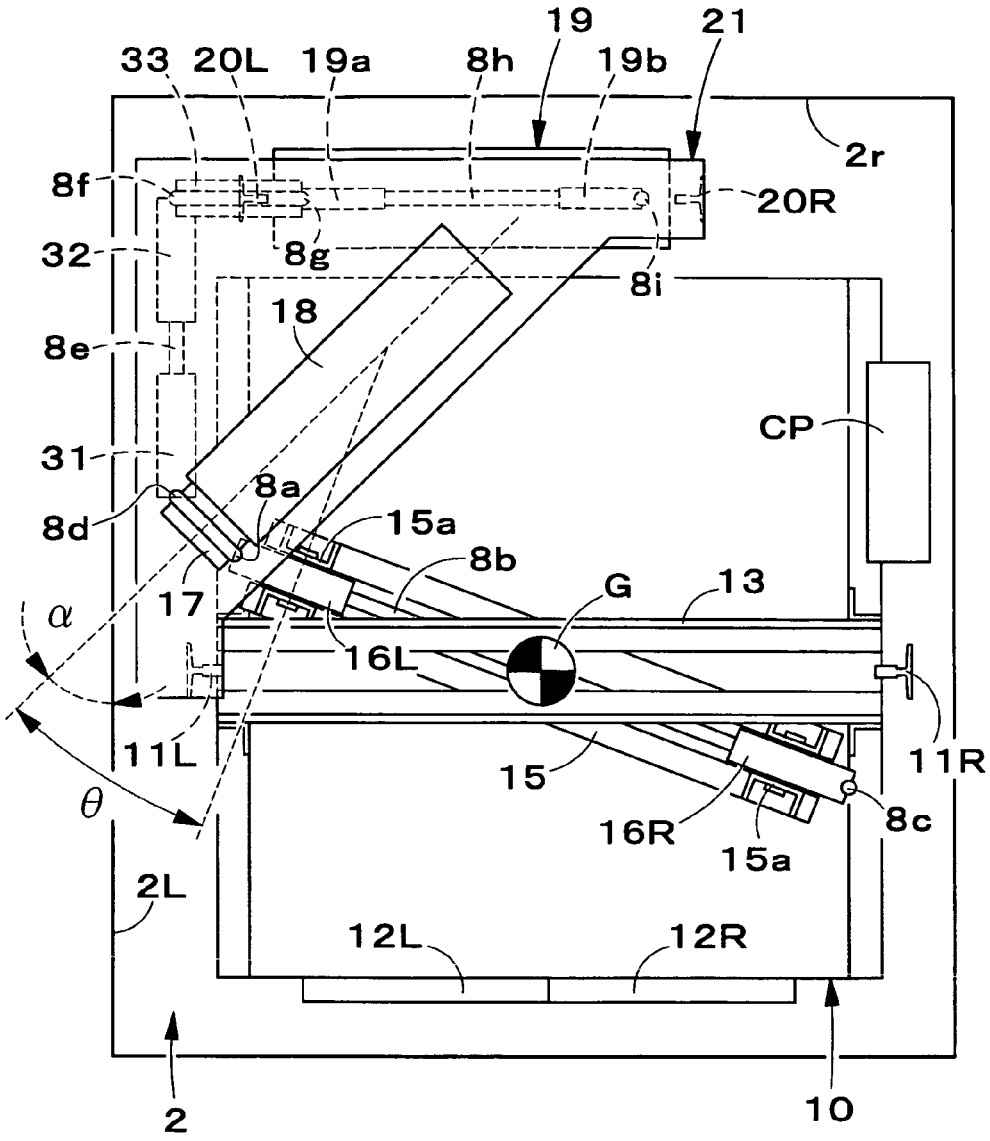
FIG. 3 is a top view of the machineroom-less elevator shown in FIG. 1.

In a vertical gap between the cage 10 and the upper beam 13, a sheave support beam 15 is disposed upwardly away from an upper surface of the cage 10. As shown in FIG. 3, the sheave support beam 15 is inclined both in the back and forth direction and the right and left direction in a horizontal plane relative to the upper beam 13, so that the sheave support beam 15 and the upper beam 13 form an X-shape when viewed vertically from above.

The sheave support beam 15 is connected to the upper beam 13 such that a longitudinal center part of an upper surface of the sheave support beam 15 is tightly in contact with a longitudinal center part of a lower surface of the upper beam 13. Thus, a force acting on the pair of right and left cage-side sheaves 16L and 16R for upwardly suspending the cage 10 can be transmitted from the sheave support beam 15 to the cage 10 through the upper beam 13 and the pair of right and left longitudinal beams 14L and 14R.

Brackets 15*a* for rotatably supporting the pair of right and left cage-side sheaves 16L and 16R are disposed on upper ends of the sheave support beam 15.

Since the sheave support beam 15 can be positioned lower than rotational axes of the pair of right and left cage-side sheaves 16L and 16R, the upper beam 13 of the cage frame can be disposed adjacent to an upper surface of the cage 10.

Thus, it is possible to reduce a so-called top clearance, that is, a vertical gap between a ceiling of the elevator shaft and an uppermost part of the cage 10 when the cage 10 is elevated in an uppermost position.

As shown in FIG. 3, on a top of the elevator shaft 2, a traction sheave 17 is disposed near a left wall 2L of the elevator shaft 2 on substantially a center position of the left wall 2L in the back and forth direction. A rotational axis of the traction sheave 17 is inclined relative to the left wall 2L and horizontally extends to a rear wall 2*r* when viewed vertically from above.

Behind the traction sheave 17, a driving apparatus 18 for driving the traction sheave 17 in rotation is disposed coaxially therewith.

A pair of right and left counterweight-side guide rails 20L and 20R for guiding a counterweight 19 which is vertically moved along the rear wall 2*r* of the elevator shaft 2 are disposed below a rear end of the driving apparatus 18.

The driving apparatus 18 is mounted and secured on a horizontally extending support table 21 supported by the pair of right and left guide rails 20L and 20R and the left cage-side guide rail 11L.

Figure 1:
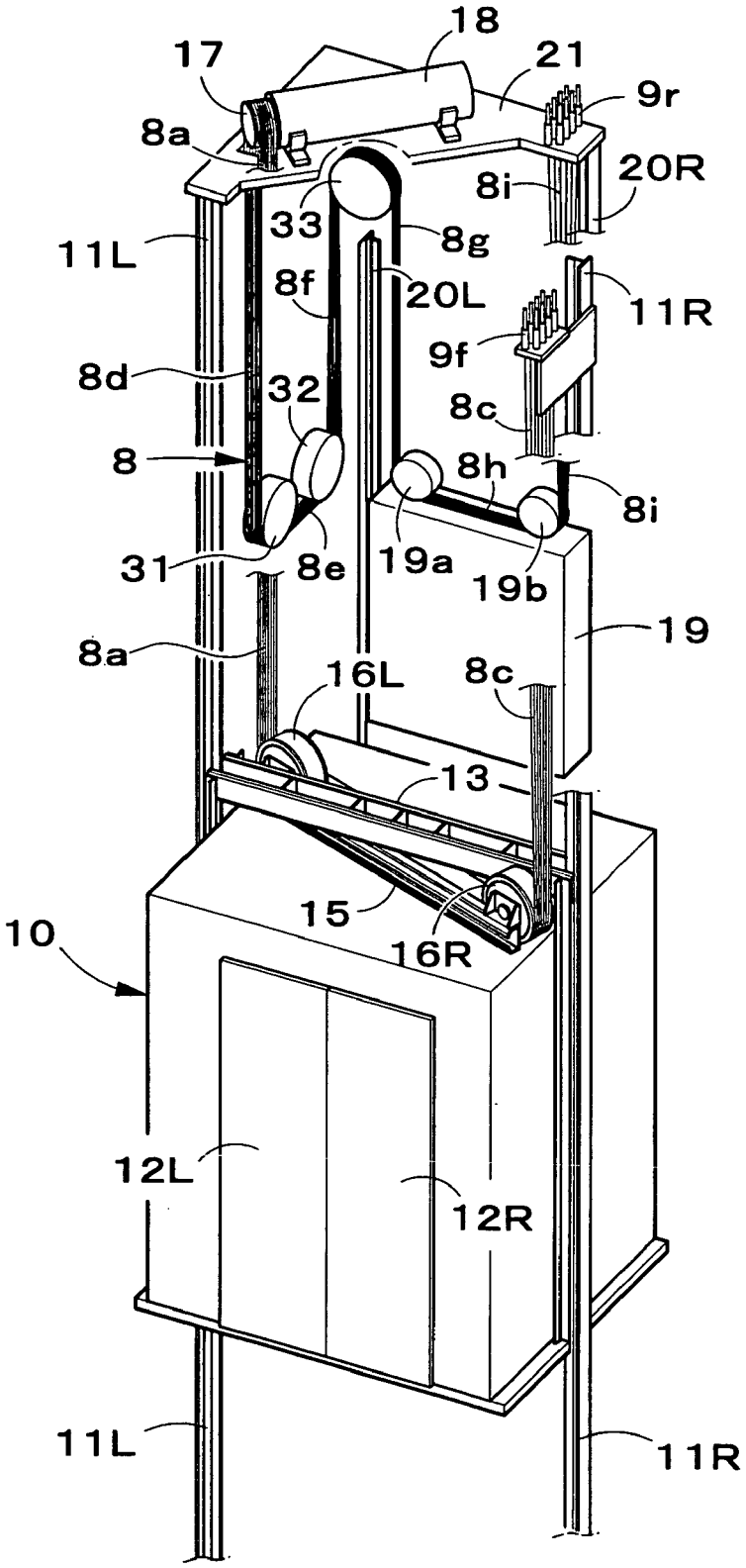
FIG. 1 is a perspective view of a machineroom-less elevator according to an embodiment of the present invention.
Figure 2:
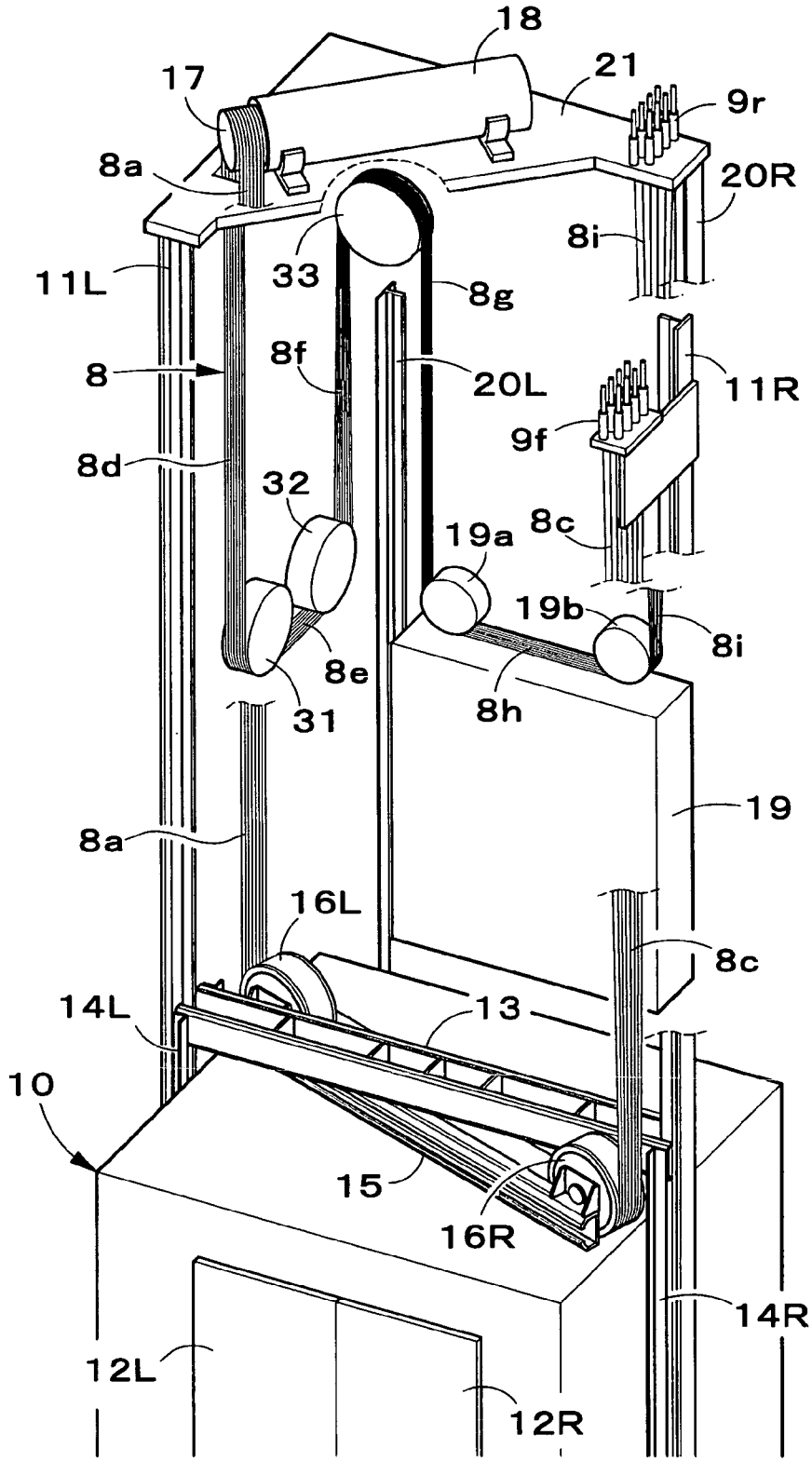
FIG. 2 is an enlarged perspective view of a substantial part of FIG. 1.

As shown in FIGS. 1 and 2, first diverting sheaves 31 and 32 capable of being rotated about a rotational axis horizontally extending in the right and left direction are disposed far below the traction sheave 17, near the left wall 2L of the elevator shaft 2, and on a part rearward a center part of the left wall 2L in the back and forth direction.

The first diverting sheaves 31 and 32 are supported by a not-shown horizontally extending support member which is bridged between the left cage-side guide rail 11L and the left counterweight-side guide rail 20L.

A second diverting sheave 33 capable of being rotated about a rotational axis horizontally extending in the back and forth direction is disposed directly below the support table 21, near the rear wall 2*r* of the elevator shaft 2, and on a left end side of the rear wall 2*r*.

The second diverting sheave 33 is supported by a not shown horizontally extending support member which is bridged between the pair of right and left counterweight-side guide rails 20L and 20R.

A hoist rope 8 is passed round the traction sheave 17, the hoist rope 8 being formed by arranging eight ropes in parallel with each other each having an outer diameter of 5 mm, for example.

An end of the hoist rope 8 is composed of a part 8*a* extending downward from the traction sheave 17 toward the left cage-side sheave 16L via a through-hole passing through the support table 20, a part 8*b* horizontally extending between the pair of right and left cage-side sheaves 16L and 16R which support and suspend the cage 10, and a part 8*c* extending upward from the right cage-side sheave 16R to be secured on a front hitch part 9*f*, so as to suspend the cage 10 in a two-to-one roping arrangement.

The other end of the hoist rope 8 is composed of a part 8*d* extending downward toward the front first diverting sheave 31 disposed below the traction sheave 17, a part 8*e* horizontally extending between the pair of back and forth first diverting sheaves 31 and 32, a part 8*f* extending upward from the rear first diverting sheave 32, a part 8*g* being passed round the second diverting sheave 33 and extending downward toward the left counterweight-side sheave 19*a*, a part 8*h* horizontally extending between the pair of right and left counterweight-side sheaves 19*a* and 19*b*, and a part 8*i* extending upward from the right counterweight-side sheave 19*b* to be secured on a rear hitch part 9*r*, so as to suspend the counterweight 19 in a two-to-one roping arrangement.

As shown in FIG. 3, the pair of right and left cage-side sheaves 16L and 16R are disposed in symmetry with respect to a center of gravity G of the cage 10 when viewed vertically from above.

In other words, the pair of right and left cage-side sheaves 16L and 16R are disposed such that the part 8*b* of the hoist rope 8 horizontally extending between the pair of right and left cage-side sheaves 16L and 16R passes above the center of gravity G of the cage 10, when viewed vertically from above.

In addition, the pair of right and left cage-side guide rails 11L and 11R are disposed in symmetry in the right and left direction with respect to the center of gravity G of the cage 10.

Thus, since a gravity acting on the cage and a force for suspending the cage upward are prevented from being largely offset from each other in the horizontal direction, the cage can be suspended in a stable manner without inclination thereof, and can be vertically moved in a smooth manner without vibrations.

Since the hoist rope 8 is formed by arranging eight ropes of smaller outer diameter such as 5 mm, the outer diameters of the pair of respective right and left cage-side sheaves 16L and 16R can be restrained to be in a range of from 200 mm to 250 mm.

In this way, the pair of right and left cage-side sheaves 16L and 16R are prevented from being interfered with by the upper beam 13, and vice versa. Thus, as shown in FIG. 3, an angle formed between the upper beam 13 and the sheave support beam 15 can be made smaller when viewed vertically from above.

Therefore, a degree of freedom of an arrangement of the pair of right and left cage-side sheaves 16L and 16R can be enhanced, when viewed vertically from above.

As shown in FIG. 3, a degree of freedom of an arrangement of the pair of right and left cage-side sheaves 16L and 16R can be enhanced, by suitably adjusting an angle $\alpha$ of a rotational axis of the traction sheave 17 relative to the left wall 2L of the elevator shaft 2, when viewed vertically from above.

Further, in comparison with a conventional elevator using a flat, flexible rope or belt in which a rotational axis of the traction sheave and rotational axes of cage-side sheaves are parallel to each other, in the machineroom-less elevator according to the present embodiment, the driving apparatus, the traction sheave, the cage-side sheaves, and the guide rails can be more freely disposed in the elevator shaft 2, while disposing the pair of right and left cage-side sheaves 16L and 16R and the pair of right and left cage-side guide rails 11L and 11R in symmetry with respect to the center of gravity of the cage 10.

In other words, by disposing the traction sheave 17 and the pair of right and left cage-side sheaves 16L and 16R in a manner as stated above, a system can be freely constituted in accordance with cross-sections of the elevator shaft 2 and the cage 10.

The pair of right and left cage-side sheaves 16L and 16R are disposed such that, when viewed vertically from above, an angle $\theta$ of the rotational axes of the pair of right and left cage-side sheaves 16L and 16R relative to the rotational axis of the traction sheaves 17 is 0 degree to 45 degrees, more preferably, 0 degree to 30 degrees, and most preferably, 0 degree to 15 degrees.

Thus, a torsion angle of the part 8*a* of the hoist rope 8 extending between the traction sheave 17 and the left cage-side sheave 16L can be minimized.

Therefore, when the cage 10 is elevated to the uppermost position so that a vertical gap between the traction sheave 17 and the left cage-side sheave 16L is narrowed, a displacement of an angle between the direction of rope grooves, which are recessedly disposed on outer peripheral surfaces of the traction sheave 17 and the left cage-side sheave 26L extend, and a direction in which the respective ropes extend can be kept small.

In detail, the rope extending downward from the rope groove of the traction sheave 17 toward the left cage-side sheave 16L does not always vertically extend downward, but extends downward with slight inclination in both the back and forth direction and the right and left direction according to a position of the left cage-side sheave 16L. Thus, a wall surface of the rope groove of the traction sheave 17 is rubbed by the respective ropes. However, in the machineroom-less elevator according to the present embodiment, a displacement of angle between a direction of the rope grooves and a direction in which the respective ropes extend from the rope grooves can be kept small.

Thus, a generation of noises and vibrations accompanied with a contact of the respective ropes formed by twisting lines with the rope grooves of the respective sheaves can be prevented. In addition, a durability of the hoist rope 8 can be improved.

In the machineroom-less elevator according to the present embodiment, the counterweight 19 is vertically moved behind the cage 10 along the rear wall 2*r* of the elevator shaft 2. The traction sheave 17 and the first diverting sheaves 31 and 32 are disposed near the left wall 2L of the elevator shaft 2, while the second diverting sheave 33 is disposed near the rear wall 2*r* of the elevator shaft 2.

Thus, even when the first diverting sheaves 31 and 32 are sufficiently spaced apart below the traction sheave 17, the first diverting sheaves 31 and 32 are prevented from being interfered with by the counterweight 19, and vice versa. In addition, the second diverting sheave 33 can be disposed on an uppermost part of the elevator shaft 2 irrespective of the traction sheave 17.

As a result, since an interference between the second diverting sheave and the counterweight can be prevented, a sufficiently large vertical stroke of the counterweight can be secured.

Since the first diverting sheaves 31 and 32 can be disposed sufficiently below the traction sheave 17, a drawing of the parts 8*d*, 8*e*, 8*f*, and 8*g* of the hoist rope 8 extending from the traction sheave 17 to the counterweight-side sheaves 19*a*and 19*b* through the first diverting sheaves 31 and 32, and the second diverting sheave 33 can be mitigated.

Thus, a durability of the hoist rope 8 can be improved. Further, no tensile difference is generated in the respective parts of the hoist rope 8, so that vertical vibrations of the cage caused when the cage starts a vertical movement is prevented, and a generation of noises and vibrations accompanied with a contact of the rope grooves of the respective sheaves with the hoist rope can be prevented.

Figure 4:
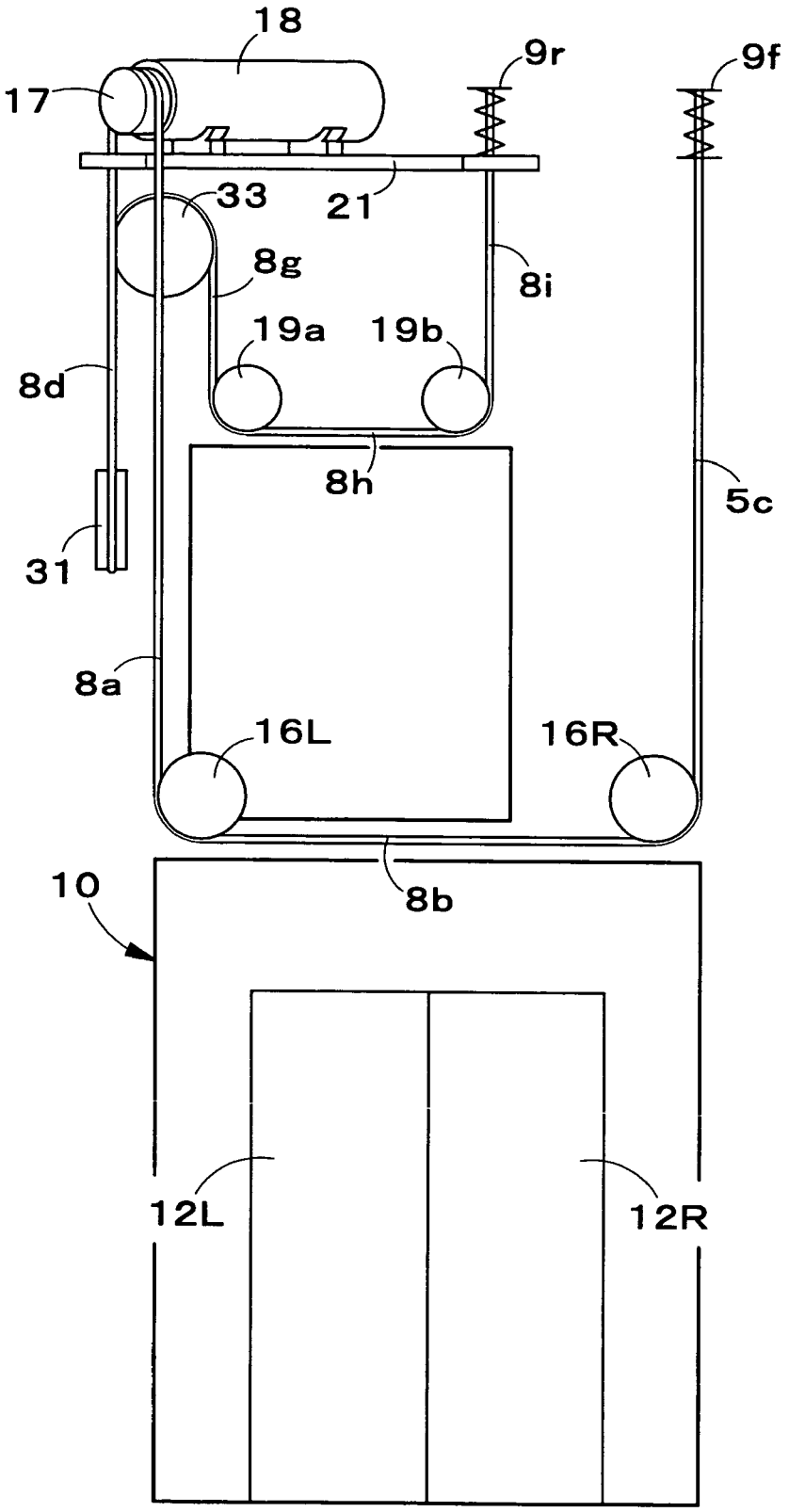
FIG. 4 is a front view schematically showing an arrangement of a traction sheave and cage-side sheaves.
Figure 5:
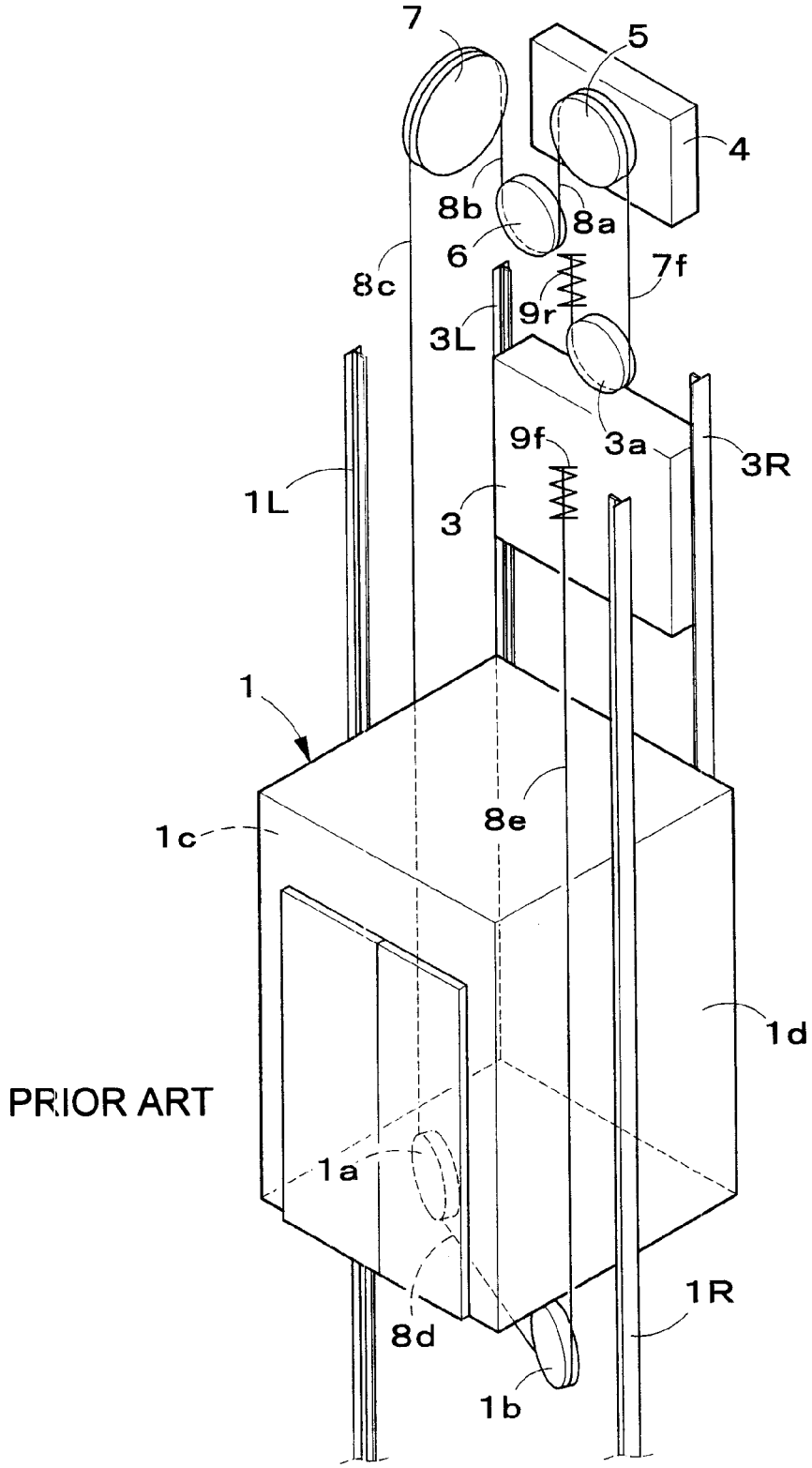
FIG. 5 is a perspective view schematically showing a conventional machineroom-less elevator.
Figure 6:
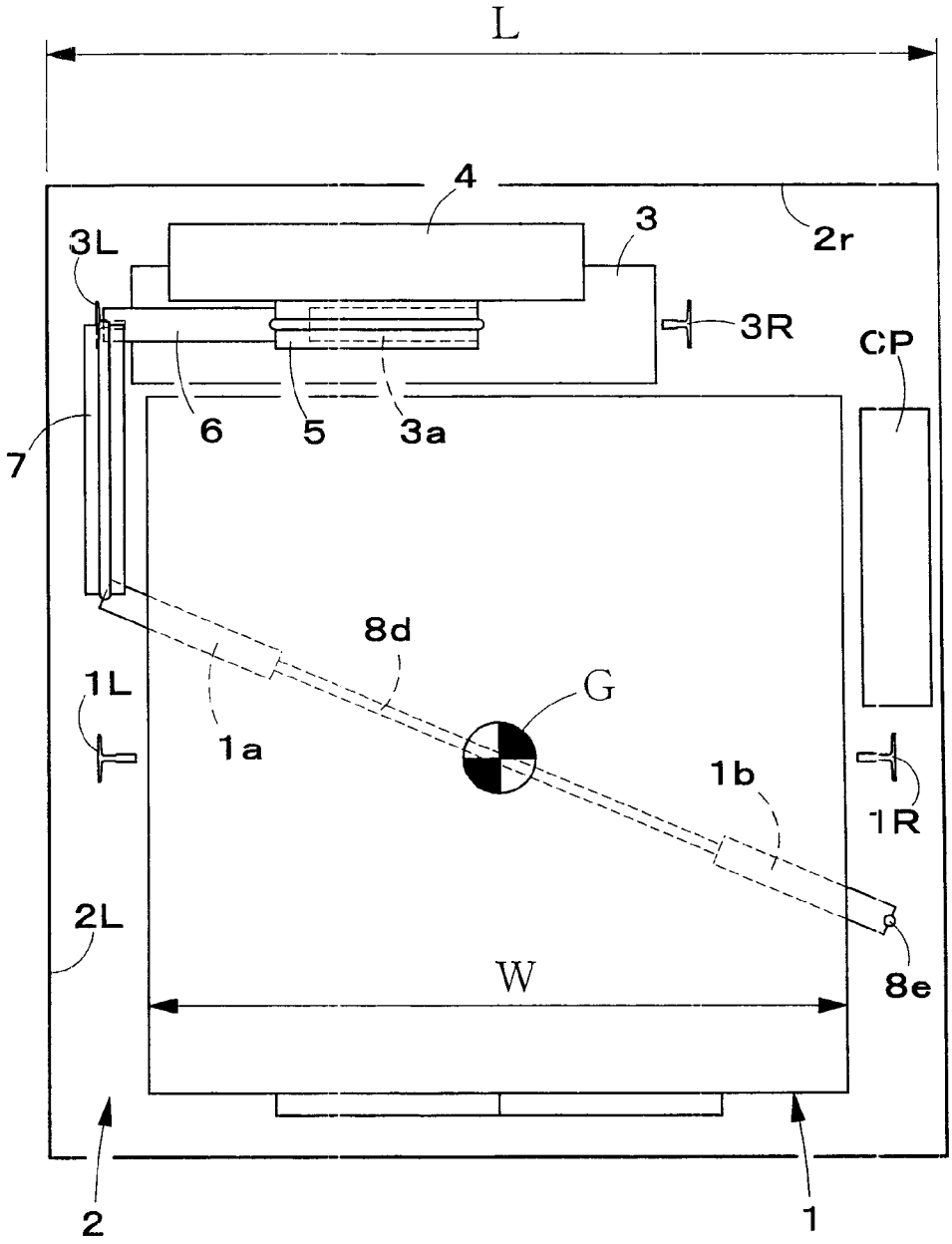
FIG. 6 is a top view of the machineroom-less elevator shown in FIG. 5.
Figure 7:
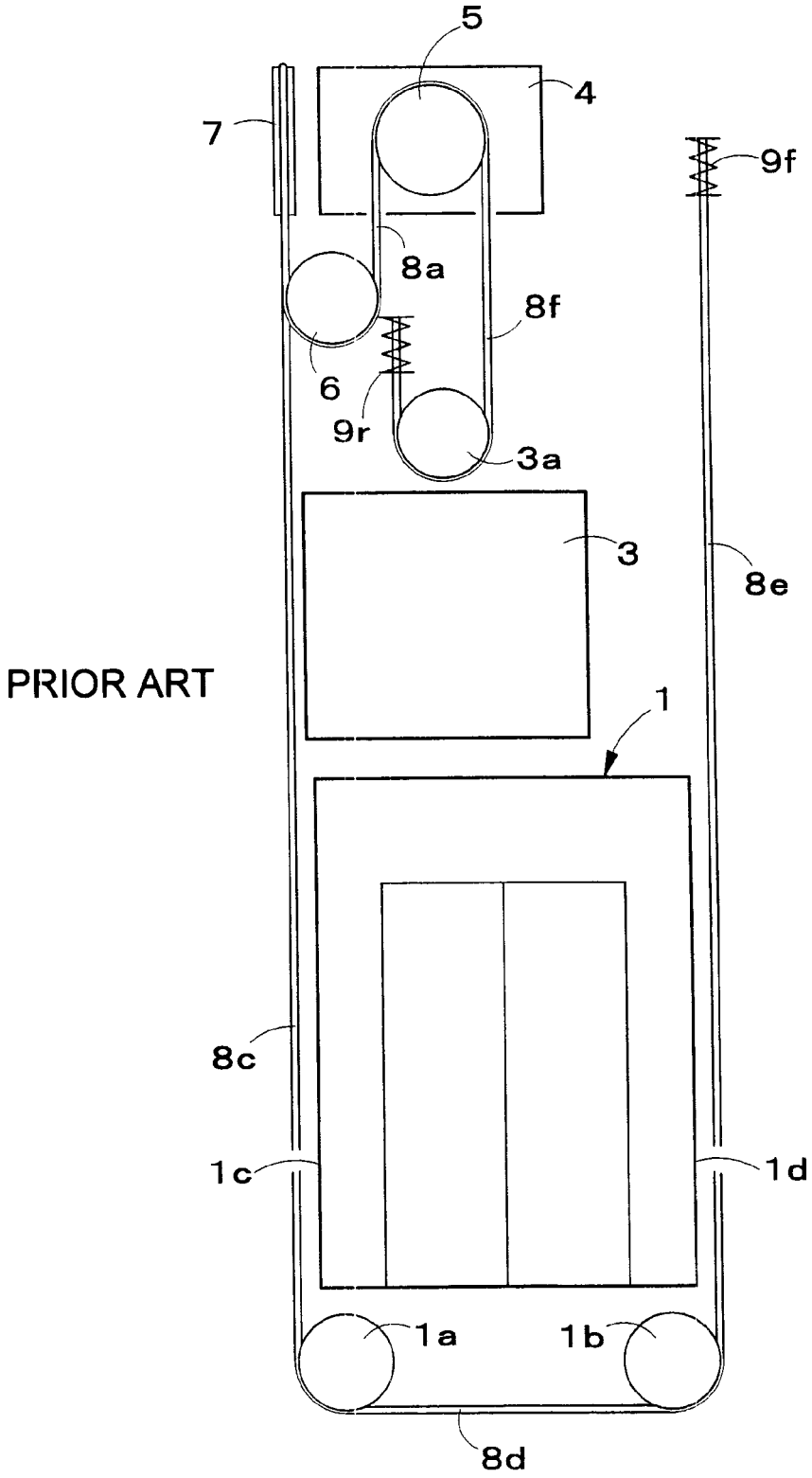
FIG. 7 is a front view of the machineroom-less elevator shown in FIG. 5.

As shown in FIG. 4, the pair of right and left cage-side sheaves 16L and 16R are disposed above the cage 10 near the right and left sidewalls 10L and 10R of the cage 10.

Thus, there is no need to dispose an operation space required for maintaining the pair of right and left cage-side sheaves 16L and 16R in a bottom of the elevator shaft, so that a depth of the pit in the bottom of the elevator shaft can be reduced.

In addition, there exists neither a cage-side sheave nor a hoist rope below the cage 10. Thus, a buffer disposed on a bottom of the elevator shaft can be disposed in opposition to a center part of a bottom surface of the cage 10.

Maintenance of the pair of right and left cage-side sheaves 16L and 16R, the traction sheave 17, the driving apparatus 18, and a controller CP disposed on a top of the elevator shaft for controlling an operation of the driving apparatus 18 can be centrally carried out above the cage 10. Since an operator needs not move up and down between an uppermost floor and a lowermost floor in a building, a maintenance operation of the machineroom-less elevator can be efficiently carried out.

Since the hoist rope 8 does not extend along the right and left sidewalls 10L and 10R of the cage 10, a dimension of the cage 10 in the right and left direction can be enlarged to be a dimension W2 such that the left sidewall 10L of the cage 10 is positioned below the traction sheave 17.

Thus, a larger space for the cage 10 can be secured when a horizontal cross-section of the elevator shaft is made to be constant.

In other words, a dimension of a horizontal cross-section of the elevator shaft can be made smaller, when a dimension of the horizontal cross-section of the cage 10 is made to be a constant one.

Since the left cage-side sheave 16L is positioned directly below the traction sheave 17, a winding angle of the hoist rope 8 with respect to the traction sheave 17 can be as large as substantially 180°, the hoist rope 8 can be securely friction-engaged with the traction sheave 17.

Although one embodiment of the machineroom-less elevator according to the present invention has been described in detail, the present invention is not limited thereto and various modifications and changes are of course possible.

For example, in the above embodiment, the first diverting sheaves are composed of the pair of back and forth sheaves 31 and 32 disposed near the left wall 2L of the elevator shaft 2. However, when the traction sheave 17 is disposed nearer to the rear wall 2*r* of the elevator shaft 2, the first diverting sheave can be composed only of the front sheave 31.

Similarly, in the above embodiment, the second diverting sheave is composed of the single sheave 33 disposed near the rear wall 2*r* of the elevator shaft 2. However, when the counterweight 19 is disposed away from the left wall 2L of the elevator shaft 2, the second diverting sheave can be composed of a pair of right and left sheaves.

As apparent from the above description, according to the present invention, a machineroom-less elevator can be provided in which a counterweight is vertically moved behind the cage. In the machineroom-less elevator, a sufficiently large vertical stroke of a counterweight can be secured, while a durability of a hoist rope is improved by mitigating a drawing of the hoist rope. Since no tensile difference is generated in respective parts of the hoist rope, vertical vibrations of the cage are prevented when the cage restarts a vertical movement. Further, a generation of noises and vibrations accompanied with a contact of rope grooves of respective sheaves with the hoist rope can be prevented.

The invention claimed is:

1. A machineroom-less elevator, comprising:

a cage that moves vertically in an elevator shaft, the cage is guided by a pair of right and left cage-side guide rails and includes a pair of right and left doors disposed on a front surface of the cage that open and close in the right and left directions;

a counterweight which includes a counterweight-side sheave, and moves vertically behind the cage along a rear wall of the elevator shaft, the counterweight is guided by a pair of right and left counterweight-side guide rails;

a traction sheave which is disposed on a top of the elevator shaft near one of right and left sidewalls of the elevator shaft, and is driven in rotation about a rotational axis extending from the sidewall to the rear wall when viewed vertically from above;

a driving apparatus which drives the traction sheave in rotation;

a pair of right and left cage-side sheaves which suspend and support the cage on an upper part thereof, and which rotate about rotational axes parallel to a rotational axis of the traction sheave, or about rotational axes extending at an angle adjacent to the rotational axis of the traction sheave;

a first diverting sheave which is disposed lower than the traction sheave near the sidewall, and is rotated about a first rotational axis extending in the right and left direction;

a second diverting sheave which is disposed higher than the first diverting sheave said second diverting sheave is near the rear wall, and is rotated about a second rotational axis, perpendicular to the first rotational axis, extending in the rear and front direction; and a hoist rope passed around the traction sheave, with a first end of the hoist rope suspending the cage through the pair of right and left cage-side sheaves, and a second end thereof suspending the counterweight through the first and second diverting sheaves and the counterweight-side sheaves.

2. The machineroom-less elevator according to claim 1, wherein the driving apparatus is coaxially disposed with the traction sheave.

3. The machineroom-less elevator according to claim 1, wherein the hoist rope includes a plurality of ropes each having a diameter of 4 mm to 6 mm.

4. The machineroom-less elevator according to claim 1, wherein the rotational axis of the traction sheave and the rotational axes of the cage-side sheaves extend at an angle of 0 degree to 45 degrees when viewed vertically from above.

5. The machineroom-less elevator according to claim 1, wherein the pair of right and left cage-side sheaves are respectively disposed near the right and left sidewalls of the cage.

6. The machineroom-less elevator according to claim 1, wherein the pair of right and left cage-side sheaves are disposed inside a vertical projection of the cage when viewed vertically from above.

7. The machineroom-less elevator according to claim 1, wherein the pair of right and left cage-side sheaves are disposed in symmetry with respect to a center of gravity of the cage when viewed vertically from above.

8. The machineroom-less elevator according to claim 1, wherein the driving apparatus is disposed such that at least a part thereof is overlapped with the cage when viewed vertically from above.

9. The machineroom-less elevator according to claim 1, wherein the traction sheave is disposed such that at least a part thereof is overlapped with the cage when viewed vertically from above.

10. The machineroom-less elevator according to claim 1, wherein the driving apparatus is mounted on a horizontally extending support table supported by the pair of right and left counterweight-side guide rails and the left cage-side guide rail, and the second diverting sheave is disposed directly below the support table.

* * * * *